US007692118B2

(12) United States Patent
Itoh et al.

(10) Patent No.: US 7,692,118 B2
(45) Date of Patent: Apr. 6, 2010

(54) GLOW PLUG AND METHOD FOR MANUFACTURING THE SAME

(75) Inventors: Shinsuke Itoh, Kohnan (JP); Takaya Yoshikawa, Kasugai (JP)

(73) Assignee: NGK Spark Plug Co., Ltd., Aichi (JP)

( * ) Notice: Subject to any disclaimer, the term of this patent is extended or adjusted under 35 U.S.C. 154(b) by 385 days.

(21) Appl. No.: 11/656,400

(22) Filed: Jan. 23, 2007

(65) Prior Publication Data

US 2008/0142496 A1 Jun. 19, 2008

(30) Foreign Application Priority Data

Dec. 19, 2006 (JP) ..... P2006-341833

(51) Int. Cl.
*F23Q 7/00* (2006.01)
*F23Q 7/22* (2006.01)

(52) U.S. Cl. ..... 219/260; 219/270

(58) Field of Classification Search ..... 219/260, 219/261, 262, 263, 364, 265, 266, 267, 268, 219/269, 270

See application file for complete search history.

(56) References Cited

U.S. PATENT DOCUMENTS 4,764,703 A * 8/1988 Meyer ..... 313/126
6,744,015 B2 * 6/2004 Tanaka et al. ..... 219/267
6,900,412 B2 5/2005 Taniguchi et al.
2002/0117492 A1 8/2002 Teramura et al.
2002/0195443 A1 12/2002 Tanaka et al.

FOREIGN PATENT DOCUMENTS

JP 60-103229 6/1985
JP 11-2406 1/1999
JP 11-176563 7/1999

* cited by examiner

*Primary Examiner*—Daniel L Robinson
(74) *Attorney, Agent, or Firm*—Sughrue Mion, PLLC

(57) ABSTRACT

A glow plug including a center pole extending along an axial direction; a heater including a heating element capable of generating heat upon energization, which heater is connected to a leading end portion of the center pole so as to constitute together with the center pole an integrated heater/center pole member in a mechanically rigid state; a metal shell as defined herein; and a vibration preventing member for preventing vibration of the center pole, the vibration preventing member being fixed on an outer peripheral surface of the center pole at an axial position corresponding to a portion where an inside diameter of the axial hole of the metal shell is constant.

10 Claims, 12 Drawing Sheets

GLOW PLUG AND METHOD FOR MANUFACTURING THE SAME

BACKGROUND OF THE INVENTION

1. Field of the Invention

The present invention relates to a glow plug for assisting start-up of a diesel engine and a method for manufacturing the same.

2. Description of the Related Art

Conventionally, a glow plug used for assisting start-up of a diesel engine has a metallic tubular metal shell, in which a rod-like heater is directly or indirectly held on a leading end side of its axial hole such that a leading end portion of the heater projects therefrom. In addition, a metallic rod-like center pole projects from a rear end side of the metal shell, and is held in the axial hole so as to be electrically insulated from the metal shell. A pair of electrodes for energizing the heater are electrically connected to the metal shell and the center pole, respectively.

The diesel engines in which glow plugs having the above-described structure are used are undergoing a shift toward direct injection type diesel engines in place of conventional auxiliary chamber type diesel engines. This is in the light of demands in recent years for features such as compact size, more efficient fuel consumption, and higher output. In addition, there are cases where the engine mounting structure is changing in conjunction with this trend, so that there is a need for compact-sized or elongated glow plugs. Further, there are frequent cases where ceramic heaters are used which provide high corrosion resistance.

As the overall length of the glow plug has increased, the natural frequency of the center pole has decreased. Consequently, instances in which the frequency of the vibrational load occurring upon operation of the diesel engine coincide with the natural frequency of the center pole have increased. Hence, a possibility has arisen that resonance can frequently occur which is undesirable. If resonance occurs, there is a possibility that a portion of the center pole corresponding to its vibration loop will come into contact with the inner peripheral surface of the metal shell, thus loosing the electrical insulating characteristic. In addition, the greater the amplitude the greater the deflection of the center pole, such that the center pole can possibly break. Furthermore, the ceramic heater may break due to internal stress transmitted from the center pole.

Accordingly, a glow plug has been proposed in which the lead members of the center pole are covered with an insulating coating to prevent short-circuiting between the center pole and the metal shell due to the resonance. Also, the outside diameter of a vibration preventing member is made close to the inside diameter of the metal shell so as to suppress the amplitude of the vibration loop, whereby the stress is alleviated to prevent breakage of the center pole (e.g., refer to JP-A-11-176563). If the stress occurring due to resonance of the center pole is reduced, it also becomes possible to prevent breakage of the ceramic heater.

3. Problems to be Solved by the Invention

However, compact metal shells are now used in conjunction with compact glow plugs, and the clearance between the inner peripheral surface of the axial hole and the outer peripheral surface of the center pole has become small. Consequently, in the process of manufacturing the glow plug it is difficult to insert an insulating coating as the vibration preventing member as proposed by JP-A-11-176563 into the axial hole of the metal shell with the center pole inserted therein. Accordingly, even if the center pole is covered in advance with the insulating coating, and the center pole is inserted into the axial hole, there is a possibility that the insulating coating whose thickness has been made thin to conform with the clearance becomes turned up and broken. Also, there is another problem in that even if the vibration preventing member is interposed in such a small clearance, since the thickness of the vibration preventing member itself becomes very thin, it is difficult to obtain a sufficient vibration preventing effect. Meanwhile, in the case where the outside diameter of the center pole itself is made small to secure the thickness of the vibration preventing member, its rigidity declines. As such, there is a possibility that when bending occurs due to stress caused by the resonance, the center pole becomes plastically deformed.

The present invention has been achieved to overcome the above-described problems, and an object thereof is to provide a glow plug which makes it possible to obtain a sufficient vibration preventing effect by interposing a vibration preventing member in the clearance between the center pole of a heater/center pole integrated member which is in a mechanically rigid state and the axial hole of the metal shell, as well as a method of manufacturing the same.

SUMMARY OF THE INVENTION

To attain the above object, and in accordance with a first aspect, the invention provides a glow plug comprising: a center pole extending along an axial direction; a heater including a heating element, said heater being connected to a leading end portion of the center pole; a metal shell which has an axial hole extending in the axial direction, the center pole being inserted into the axial hole so as to be spaced apart from an inner peripheral surface of the axial hole, the metal shell radially holding a rear end portion of the center pole directly or indirectly while causing the rear end portion of the center pole to project from a rear end portion of the metal shell, the metal shell at its leading end portion radially holding directly or indirectly the heater; and a vibration preventing member for preventing vibration of the center pole, the vibration preventing member being fixed on an outer peripheral surface of the center pole at an axial position corresponding to a portion where an inside diameter of the axial hole of the metal shell is constant.

In accordance with a second aspect of the invention, the glow plug according to the first aspect is characterized in that the heater is integrated with the center pole in a mechanically rigid state.

In accordance with a third aspect of the invention, the glow plug according to the first aspect is characterized in that the center pole has, within the axial hole of the metal shell, a small-diameter portion formed by configuring a portion of the outer peripheral surface to be of smaller diameter than another portion of the outer peripheral surface of the center pole, and the vibration preventing member circumferentially covers at least a portion of the small-diameter portion.

In accordance with a fourth aspect of the invention, the glow plug according to the third aspect is characterized in that the outer peripheral surface of the small-diameter portion is subjected to processing so as to increase its surface roughness.

In accordance with a fifth aspect of the invention, the glow plug according to any of the first to fourth aspects is characterized in that the vibration preventing member is press fitted at the time that the center pole is inserted into the axial hole of the metal shell, and is disposed so as to be radially compressed between the inner peripheral surface of the axial hole and the outer peripheral surface of the center pole.

In accordance with a sixth aspect of the invention, the glow plug according to the fifth aspect is characterized in that the vibration preventing member has a thickness on a leading end side that is greater than a thickness on the rear end side, when the vibration preventing member is fixed to the center pole.

In accordance with a seventh aspect of the invention, the glow plug according to the fifth or sixth aspects is characterized in that an outer peripheral surface of the metal shelf has a thread for mounting in an internal combustion engine formed thereon, and the vibration preventing member is disposed within the axial hole at an axial position different from that of the thread.

In accordance with an eighth aspect of the invention, the glow plug according to the first aspect is characterized in that the vibration preventing member is located axially more forward than an external threaded portion of the metal shelf, and the vibration preventing member has a thickness that is larger than the clearance between the center pole and the inner peripheral surface of the axial hole of the metal shell at the axial position where the external threaded portion is located.

In accordance with a ninth aspect of the invention, the glow plug according to the first aspect is characterized in that an inside diameter of the axial hole of the metal shell is constant in an axial range from the leading end portion of the center pole to an external threaded portion of the metal shell.

In accordance with a tenth aspect, the invention provides a method of manufacturing a glow plug according to the fourth aspect, comprising: forming a center pole having a small-diameter portion by subjecting a metallic rod material to plastic working or cutting work; subjecting the outer peripheral surface of the small-diameter portion of the center pole thus formed to processing so as to increase its surface roughness; and forming a vibration preventing member on the small-diameter portion by injection molding.

In the glow plug according to the above-described first and second aspects of the invention, since the heater/center pole integrated member is in a mechanically rigid state, even in cases where the heater/center pole integrated member, when subjected to vibration due to operation of the internal combustion engine, resonates to produce a swinging motion, the heater/center pole integrated member is not bent due to internal stress caused by the swinging motion. If the vibration preventing member is provided on such an integrated piece comprising the center pole and the heater member, the amplitude of the loop portion having fulcrums at portions where the heater/center pole integrated member is held within the metal shell can be suppressed by the vibration preventing member. Because the vibration preventing member is fixed on the outer peripheral surface of the center pole, the vibration preventing member does not swing independently of the center pole within the axial hole, and the vibration preventing member does not rattle. Thus, the stress applied to the center pole can be reduced, making it possible to obtain a more reliable vibration preventing effect. As described below, the mechanically rigid state is a state in which when the center pole of the heater/center pole integrated member is fixed, and a 200 g weight is suspended from the element at a position 25 mm from the side end face of the center pole, the angle of deformation is 30° or less.

Further, if a small-diameter portion is provided on the outer peripheral surface of the center pole, and the vibration preventing member is provided on the small-diameter portion as in the above-described third aspect of the invention, it is possible to secure, as the thickness of the vibration preventing member, a size in which the depth of the small-diameter portion is added to the dimension of the clearance between the inner peripheral surface of the axial hole of the metal shell and the outer peripheral surface of the center pole. In the case where resonance occurs in the heater/center pole integrated member, the vibration preventing member is pressed by being clamped between the center pole and the inner peripheral surface of the metal shell, and an internal stress is produced therein. However, if the vibration preventing member is formed with such a large thickness, the vibration preventing member is able to sufficiently contract to alleviate the internal stress, making it possible to obtain a sufficient vibration preventing effect.

In addition, if the vibration preventing member is provided on the outer peripheral surface of the above-described small-diameter portion after the surface is subjected to processing so as to increase its surface roughness as in the above-described fourth aspect of the invention, the vibration preventing member can be fixed to the small-diameter portion more reliably. As a result, the positional offset of the vibration preventing member can be reliably prevented, and it is possible to maintain a state in which the vibration preventing member is disposed at a position where the vibration amplitude of the heater/center pole integrated member can be suppressed more effectively in the axial direction of the center pole.

If the combustion chamber is deformed due to the combustion pressure of the internal combustion engine during operation of the internal combustion engine, the leading end side of the glow plug, which is mounted with its heater member exposed toward the combustion chamber, is subjected to pressure. At this time, since the metal shell is compressed in the axial direction between its leading end side and a threaded portion disposed on the rear end side, deformation such as radial bulging or flexing in a direction perpendicular to the axial direction can occur in the metal shell. In that case, a gap is produced between the inner peripheral surface of the metal shell and the vibration preventing member disposed on the surface of the center pole. Accordingly, if the vibration preventing member is press fitted in advance into the metal shell, and is disposed in a radially compressed state as in the above-described fifth aspect of the invention, the gap produced by deformation of the metal shell is filled by the vibration preventing member which bulges with the release of the compressive pressure, so that the vibration preventing effect can be maintained.

It is, of course, time-consuming to press fit the vibration preventing member into the metal shell in the process of manufacturing the glow plug. Accordingly, if the thickness of the leading end side of the vibration preventing member, which is the side inserted into the metal shell after the rear end side, is formed to be greater than that of the rear end side, as in the above-described sixth aspect of the invention, a situation is prevented in which the vibration preventing member is caught by an edge of the axial hole of the metal shell to cause difficulty in inserting the same. In addition, since friction with the inner peripheral surface of the metal shell can be reduced during the course of inserting the vibration preventing member deep into the interior of the metal shell, smooth insertion can be carried out.

It should be noted that the vibration preventing member is preferably located at a position different from the position corresponding to the thread forming position as in the above-described seventh aspect of the invention. Generally, the position where the thread is formed on the metal shell is less susceptible to deformation of the combustion chamber, and the inside diameter practically does not change; however, at the position where the thread is not formed, there is a high possibility that the inside diameter changes. In the case where the vibration preventing member is disposed to correspond with the thread forming position, the vibration preventing member is maintained in a compressed state, and it is difficult for the vibration preventing member to exhibit resiliency. However, if the vibration preventing member is disposed to correspond to an axial position where the thread is not present, the compressed state of the vibration preventing member is released in tune with deformation of the metal shell. As such, the vibration preventing member can be made to effectively and easily absorb energy, i.e., a so-called damper effect. Therefore, it is possible to effectively prevent vibration of the heater/center pole integrated member.

Further, in the above-described vibration preventing member, preferably, as described in the above-noted tenth aspect of the invention, after the small-diameter portion is formed on the center pole, and the outer peripheral surface of the small-diameter portion is subjected to processing so as to increase its surface roughness, the vibration preventing member is formed by injection molding. If the vibration preventing member is formed by such a manufacturing method, the vibration preventing member can be reliably fixed on the small-diameter portion, and the time and trouble involved in managing the thickness of the vibration preventing member can be mitigated. Also, a vibration preventing member capable of suppressing the vibration amplitude of the center pole can be easily formed on the outer peripheral surface of the center pole.

DETAILED DESCRIPTION OF THE INVENTION

Referring now to the accompanying drawings, the following is a description of an embodiment of a glow plug in accordance with the invention. However, the present invention should not be construed as being limited thereto.

Figure 1:
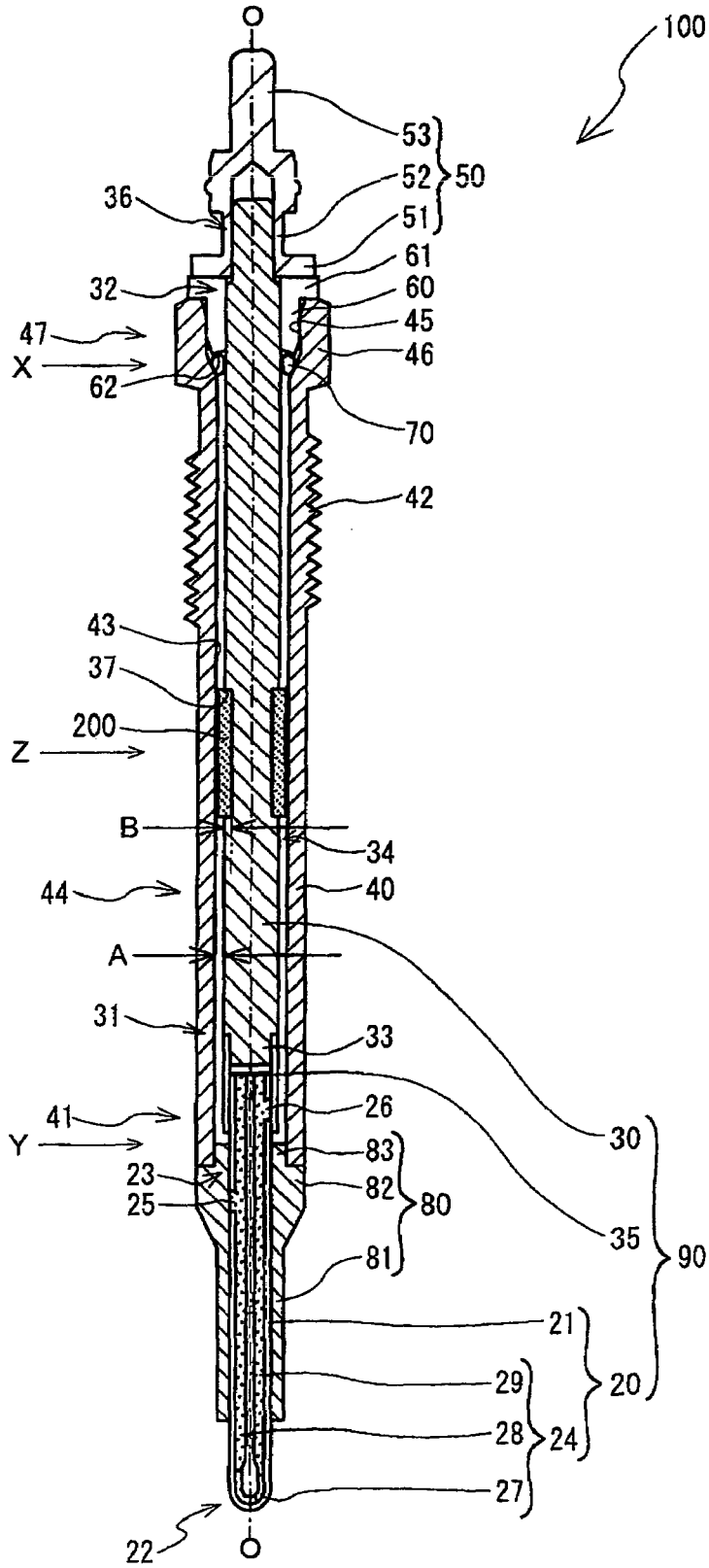
FIG. 1 is a longitudinal cross-sectional view of a glow plug 100.
Figure 2:
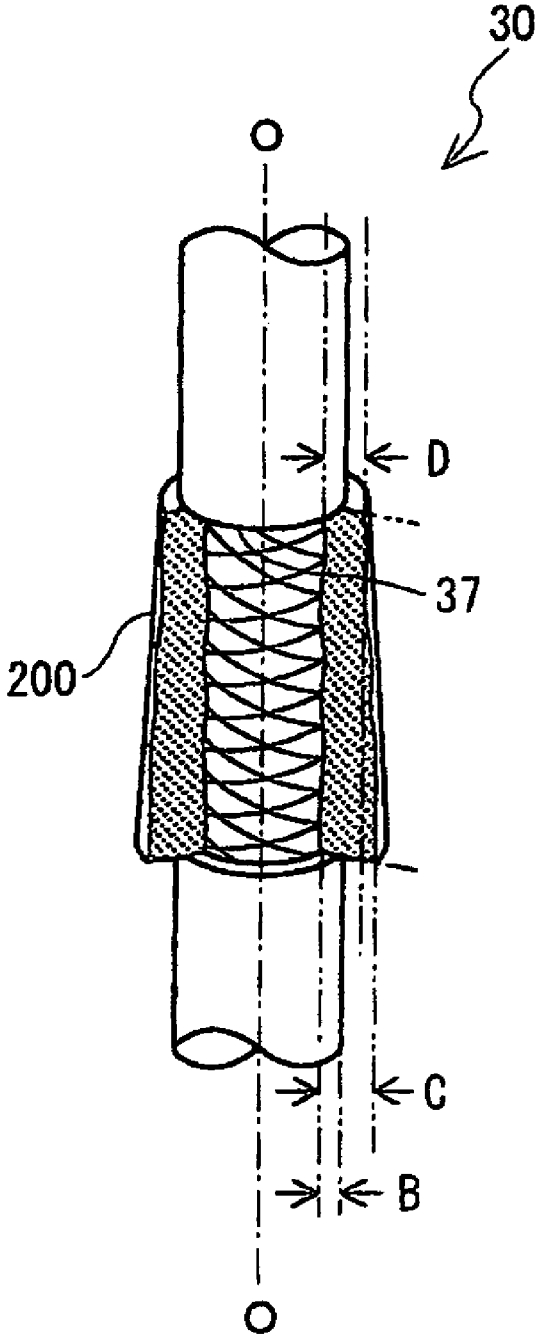
FIG. 2 is an enlarged perspective view, partly cutaway, of a vibration preventing member 200 disposed on a center pole 30, as well as its vicinity.

First, referring to FIGS. 1 and 2, a description will be given of the overall structure of a glow plug 100 in accordance with this embodiment. FIG. 1 is a longitudinal cross-sectional view of the glow plug 100. FIG. 2 is an enlarged perspective view, partly cutaway, of a vibration preventing member 200 disposed on a center pole 30, as well as its vicinity. As described herein, the side (lower side in FIG. 1) where a ceramic heater 20 is disposed in the direction of an axis O is the leading end side of the glow plug.

The glow plug 100 shown in FIG. 1 is mounted, for instance, in a combustion chamber (not shown) of a direct injection type diesel engine, and serves as a heat source for assisting in ignition when the engine is started.

The ceramic heater 20 has a structure in which a heating element 24 formed of an electrically conductive ceramic and having a substantially U-shaped cross section is embedded in the interior of an insulating ceramic substrate 21 whose leading end portion 22 has been processed into a curved shape. The heating element 24 comprises a heating member 27 which is disposed in the leading end portion 22 of the ceramic heater 20 and has both ends bent substantially in a U-shape in conformity with its curved surface, as well as a pair of lead portions 28 and 29 which are respectively connected to both ends of the heating member 27, and extend in a substantially parallel direction along the axis O toward a rear end portion 23 of the ceramic heater 20. The heating member 27 is molded such that its cross-sectional area becomes smaller than the cross-sectional area of each of the lead portions 28 and 29, and heat is generated mainly by the heating member 27 during energization. Further, respective electrode lead-out portions 25 and 26 projecting from the lead portions 28 and 29 are exposed on an outer peripheral surface of the rear end portion 23 of the ceramic heater 20 at mutually offset positions in the direction of the axis O. The ceramic heater 20 corresponds to the "heater" of the invention.

The ceramic heater 20 is held in a cylindrical tubular body 80 so as to surround an outer periphery of its trunk portion. Of the electrode lead-out portions 25 and 26, the electrode lead-out portion 25 is in contact with the tubular body 80 inside a tubular hole of the tubular body 80 and is electrically connected thereto. The tubular body 80 is formed of a metallic member, and a thick-walled collar portion 82 is formed on a rear end side of a trunk portion 81. A stepped engaging portion 83 is formed at a rear end of the collar portion 82, and an inner periphery of a leading end portion 41 of a cylindrical metal shell 40 is engaged with this engaging portion 83. At the time of engagement, the axis of the ceramic heater 20 and the axis of the metal shell 40 are aligned with the axis O. In this state, of the ceramic heater 20, a portion located rearwardly of the tubular body 80 is accommodated in the metal shell 40, and the metal shell 40 is positioned by the engaging portion 83 of the tubular body 80. Therefore, the structure is such that the electrode lead-out portion 26 provided at the rear end portion of the ceramic heater 20 is not in contact with the metallic metal shell 40. Also, the electrode lead-out portion 26 is electrically connected to the center pole 30, as described below.

The metal shell 40 is an elongated tubular metal member having an axial hole 43 extending in the direction of the axis O. An externally threaded portion 42 for mounting the glow plug 100 in the engine head (not shown) of the internal combustion engine is formed on the rear end side of a shell portion 44. In addition, a tool engaging portion 46 with an axially hexagonal cross section, for engaging with a tool at the time of mounting in the engine head, is formed on the rear end side of the trunk portion 44, which is a rear end portion 47 of the metal shell 40. The axial hole 43 has a constant diameter in an axial range from the leading end (small-diameter engaging portion 33) of the center pole 30 to the rear end of the external threaded portion 42 of the metal shell 40. The axial hole 43 has an enlarged diameter at the tool engaging portion 46, and its inside diameter is formed to be as large as an enlarged-diameter portion 45.

The center pole 30 is a metal rod extending in the direction of the axis O, and is inserted into the axial hole 43 of the metal shell 40. A leading end portion 31 of the center pole 30 is formed in a stepped shape and has a small-diameter engaging portion 33 formed at its leading end. This engaging portion 33 is engaged with a connecting ring 35 for fitting to the rear end portion 23 of the ceramic heater 20, and their peripheries are laser welded, thereby forming a heater/center-pole integrated member 90 in which the center pole 30 and the ceramic heater 20 are integrally connected. In addition, the electrode lead-out portion 26 of the ceramic heater 20 is in contact with the inner wall of a tubular hole of the connecting ring 35, and is electrically connected to the center pole 30 via the connecting ring 35. A gap electrically insulates the metal shell 40 from the center pole 30 and each of the metal shell 40 and the center pole 30 functions as an electrode for applying a voltage to the heating member 27 of the ceramic heater 20. The vibration preventing member 200 is provided on a trunk portion 34 of the center pole 30, as described below.

In addition, an insulating O-ring 70 engages a rear end portion 32 of the center pole 30, and is disposed on a leading end side inside the enlarged-diameter portion 45 of the axial hole 43 of the metal shell 40. An insulating holding ring 60 further engages the rear end portion 32 and is fitted in the enlarged-diameter portion 45 such that its leading end face 62 presses the O-ring 70 toward the leading end side in the direction of the axis O. As a result, the O-ring 70 is brought into contact with each of the outer peripheral surface of the center pole 30, the inner peripheral surface in the enlarged-diameter portion 45 of the axial hole 43, and the leading end face 62 of the holding ring 60, thereby maintaining air-tightness between inner and outer sides of the axial hole 43. Further, a collar portion 61 formed on the rear end side of the holding ring 60 abuts a rear end of the tool engaging portion 46, and is interposed between a pin terminal 50 and the metal shell 40 so as to insulate the same from one another.

Next, that portion of the rear end portion 32 of the center pole 30 which projects from the collar portion 61 of the holding ring 60 toward the rear end side is formed with a small diameter as a terminal engaging portion 36. The pin terminal 50 engages the terminal engaging portion 36. The pin terminal 50 consists of a cap-like trunk portion 52 which is fitted over the terminal engaging portion 36 to cover the same, a pin-like projecting portion 53 projecting from the trunk portion 52 toward the rear end side, and a collar portion 51 projecting radially on the leading end side of the trunk portion 52. As the outer periphery of the trunk portion 50 is crimped, the pin terminal 50 is fixed to the terminal engaging portion 36 of the center pole 30, and the pin terminal 50 and the center pole 30 are electrically connected. When the glow plug 100 is mounted in the engine head (not shown), an unillustrated plug cap is fitted over the projecting portion 53 to supply electric power from an external circuit.

In addition, a small-diameter portion 37 is formed on the trunk portion 34 of the center pole 30 at a position slightly closer to the leading end side from the center, and the vibration preventing member 200 is fixed to this small-diameter portion 37 in an engaging manner. The vibration preventing member 200 consists of an elastic silicone which is insulative, and is formed so as to surround the outer periphery of the small-diameter portion 37 by an injection molding step described below, as shown in FIG. 2. To prevent the vibration preventing member 200 from coming off, the outer peripheral surface of the small-diameter portion 37 is surface processed into a knurled form. As a result, at the time of assembling the heater/center pole integrated member 90 and the metal shell 40 in the process of manufacturing the glow plug 100, described below, when the center pole 30 with the vibration preventing member 200 fixed thereto is inserted into the axial hole 43 of the metal shell 40, frictional contact between the inner peripheral surface of the axial hole 43 and the outer peripheral surface of the vibration preventing member 200 prevents member 200 from coming off the center pole 30.

Furthermore, the vibration preventing member 200 is constructed so as to have a thickness C (thickness in the radial direction of the center pole 30) on the leading end side (lower side in the drawing), which is the leading end side of the glow plug 100 at the time of assembly, that is greater than the thickness D on the rear end side (upper side in the drawing). At this time, the structure provided is such that the thickness D on the rear end side of the vibration preventing member 200 is substantially identical to a dimension which combines a dimension A of the clearance between the inner peripheral surface of the axial hole 43 of the metal shell 40 and the outer peripheral surface of the center pole 30, as well as the depth B of the small-diameter portion 37. Namely, the vibration preventing member 200 in terms of its thickness is capable of securing at least a size in which the depth B of the small-diameter portion 37 is added to the dimension A of the aforementioned clearance. In addition, since the thickness C on the leading end side of the vibration preventing member 200 is grater than the size in which the dimension A of the aforementioned clearance and the depth B of the small-diameter portion 37 are combined, the vibration preventing member 200 is disposed in a state in which a portion on the leading end side thereof is mainly compressed within the axial hole 43 of the metal shell 40.

Furthermore, the thicknesses C and D of the vibration preventing member 200 are larger than the air gap (clearance) between the center pole 30 and the inner peripheral surface of the metal shell at a position of the external threaded portion 42.

As described above, the leading end portion 31 of the center pole 30 is fixed to the rear end portion 23 of the ceramic heater 20 to form the heater/center pole integrated member 90. The ceramic heater 20 of the heater/center pole integrated member 90 is press-fitted into the tubular body 80 which is joined to the metal shell 40, and is indirectly held by the metal shell 40. Meanwhile, the rear end portion 32 of the center pole 30 of the heater/center pole integrated member 90 is indirectly held (but not fixed) by the metal shell 40 within the axial hole 43 (within the enlarged-diameter portion 45) at the rear end of the metal shell 40 by the holding ring 60 and the O-ring 70. Namely, the heater/center pole integrated member 90 assumes a form in which it is held within the axial hole 43 of the metal shell 40 by using as fulcrums a position X where the O-ring 70 is disposed and a position Y of the rear end of the tubular body 80 in the direction of the axis O. In a case where resonance has occurred in the heater/center pole integrated member 90 due to vibrational load produced upon engine operation, in order to effectively suppress the amplitude of the vibration loop of the heater/center pole integrated member 90 at a position Z with positions X and Y set as fulcrums, the vibration preventing member 200 is disposed at position Z in this embodiment.

On the other hand, when the glow plug 100 is mounted to the engine, the glow plug 100 assumes a state in which it is fixed to the engine head at the externally threaded portion 42 of the metal shell 40, and a tapered seal portion between the trunk portion 81 and the collar portion 82 of the tubular body 80 abuts a mounting hole (not shown) of the engine head to prevent leakage and hence a reduction in combustion pressure. Further, when the combustion pressure within the combustion chamber has increased upon engine operation, and the engine head has deformed, the metal shell 40 is compressed in the direction of the axis O between the seal portion of the tubular body 80 and the externally threaded portion 42. Consequently, there are cases where the trunk portion 44 of the metal shell 40 becomes deformed in the radial direction. Specifically, there are cases where deformation occurs in which a central portion or its vicinity in the direction of the axis O of the trunk portion 44 expands in the radial direction, or in which the entire trunk portion 44 becomes curved so as to be deflected with respect to the direction of the axis O. At this time, at the position Z corresponding to the aforementioned vibration loop of the heater/center pole integrated member 90, the clearance between the inner peripheral surface of the axial hole 43 of the metal shell 40 and the outer peripheral surface of the center pole 30 is likely to partially expand. Since the vibration preventing member 200 in accordance with this embodiment is compressed in the above-described clearance between the axial hole 43 of the metal shell 40 and the center pole 30, even if the clearance expands in this manner, the vibration preventing member 200 is able to expand and fill the clearance in conjunction with alleviating the compressive stress. Hence, it is difficult for a gap to form between the vibration preventing member 200 and the axial hole 43, and therefore the amplitude of the vibration loop of the heater/center pole integrated member 90 is suppressed more effectively.

The externally threaded portion 42 formed on the rear end side of the trunk portion 44 of the metal shell 40 is a portion which is threadedly engaged with an internally threaded portion (not shown) on the mounting hole side of the engine head, and is therefore unlikely to deform when the engine head deforms upon combustion. Accordingly, a large change is unlikely to occur in the clearance between the inner peripheral surface of the axial hole 43 corresponding to the position where externally threaded portion 42 is formed and the outer peripheral surface of the center pole 30 opposing that position. In the case where the vibration preventing member 200 which is disposed in the axial hole 43 in the compressed state is provided at a position on the center pole 30 corresponding to the position where the externally threaded portion 42 is formed, the vibration preventing member 200 is kept in the compressed state and is therefore unlikely to exhibit resiliency. In general, the damper effect of absorbing energy is more likely to be exhibited in a resilient state. For this reason, if the vibration preventing member 200 is disposed at a position different from the position on the center pole 30 corresponding to the position where the externally threaded portion 42 is formed, the compressed state is easily released when the center pole 30 has swung, and the damper effect can be easily exhibited, so that this arrangement is favorable for suppressing vibration of the center pole 30.

In addition, as described above, the heater/center pole integrated member 90 has a form in which the ceramic heater 20 and the solid center pole 30 are connected by the connecting ring 35. The center pole 30 is provided with the small-diameter portion 37, as described above, and the portion with the thus-narrowed outside diameter has low rigidity as compared with the other portion. For this reason, if the heater/center pole integrated member 90 is subjected to stress due to vibration, flexing occurs in the heater/center pole integrated member 90 with this small-diameter portion 37 as a starting point. At this time, unless the heater/center pole integrated member 90 is in a mechanically rigid state, the heater/center pole integrated member 90 is not restored from its flexed state, and can possibly remain flexed at the small-diameter portion 37. Accordingly, in this embodiment, the heater/center pole integrated member 90 is preferably in a mechanically rigid state. Specifically, on the basis of the Example which is described below, the heater/center pole integrated member 90 is specified as being in a mechanically rigid state if the angle of deformation is 30° or less when, with the center pole fixed, a 200 g weight is suspended from the element at a position 25 mm from the side end face of the center pole.

Figure 3:
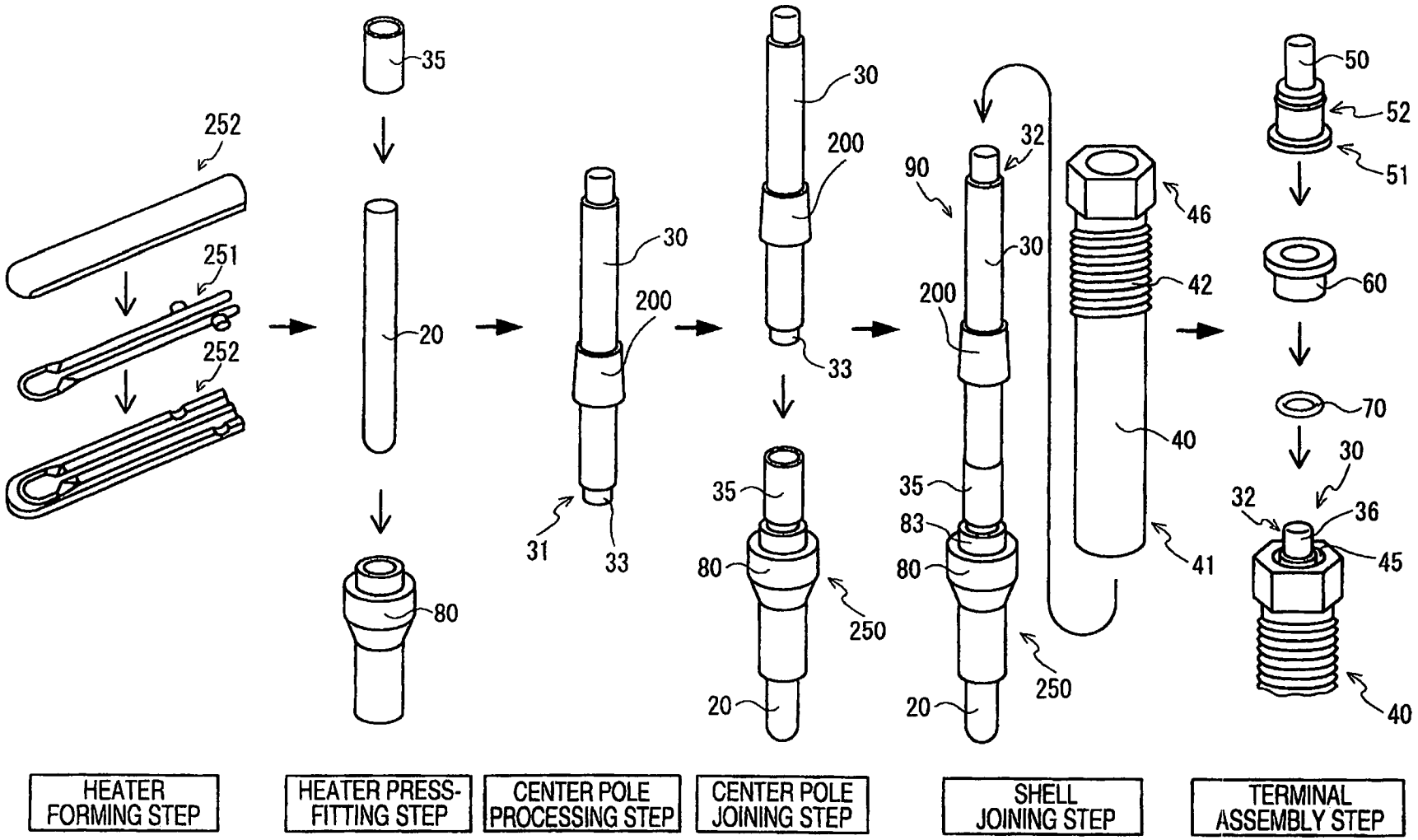
FIG. 3 is a diagram illustrating a schematic flow of the process of manufacturing the glow plug 100.
Figure 4:
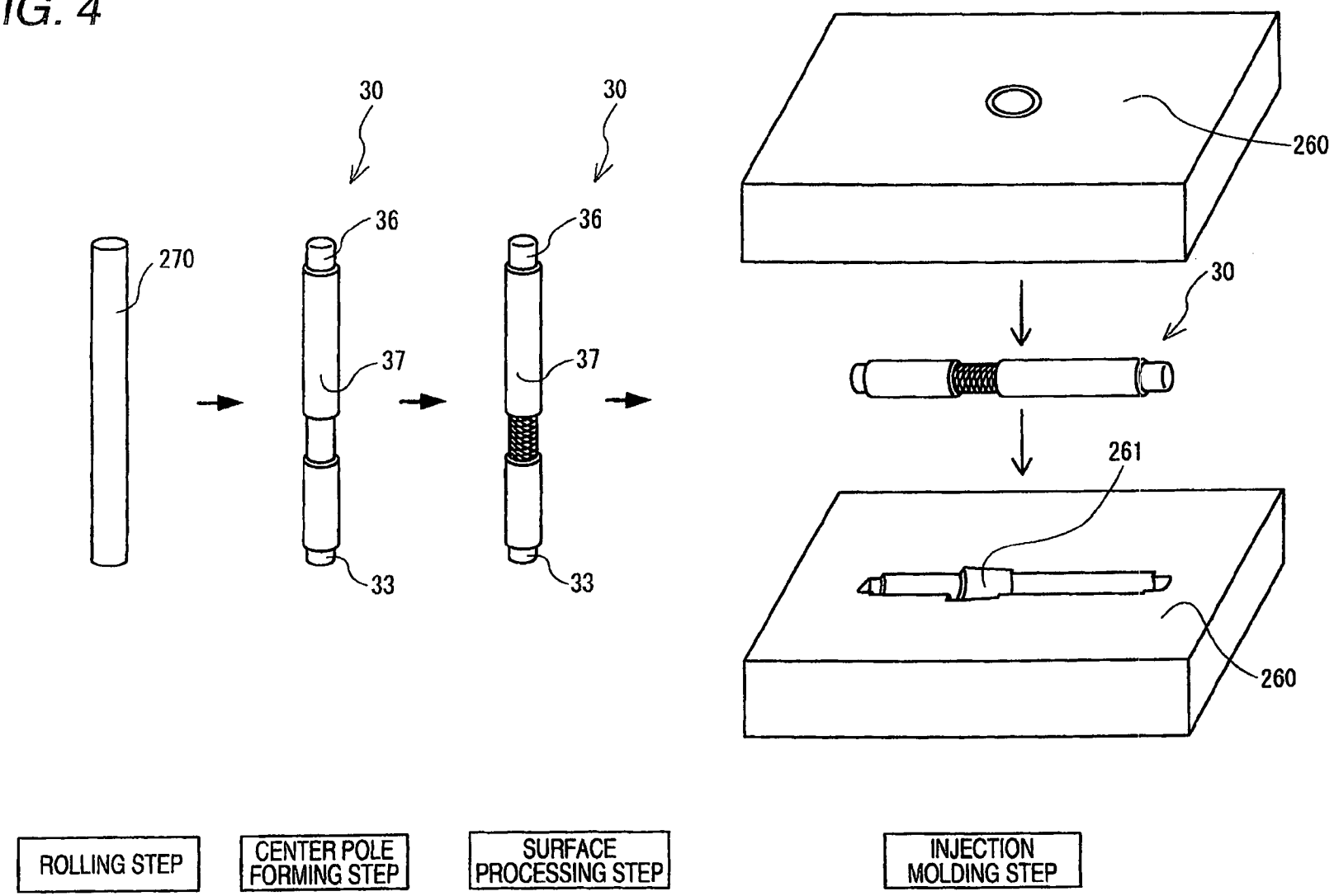
FIG. 4 is a diagram illustrating a more detailed flow of a center pole fabrication step.

In the process of manufacturing the glow plug 100 having the above-described structure, the center pole 30 with the small-diameter portion 37 formed thereon is disposed in a mold 260 (see FIG. 4), and the vibration preventing member 200 is molded on the small-diameter portion 37 by injection molding. Hereafter, referring to FIGS. 3 and 4, a description will be given of the process of manufacturing the glow plug 100. FIG. 3 is a diagram illustrating a schematic flow of the process of manufacturing the glow plug 100. FIG. 4 is a diagram illustrating a more detailed flow of a center pole fabrication step.

<Heater Forming Step>

As shown in FIG. 3, injection molding is first performed by using an electrically conductive ceramic powder, a binder, and the like as materials to thereby form an element molded body 251 serving as a prototype of the heating element 24 of the ceramic heater 20. Meanwhile, as for a substrate molded body 252 serving as a prototype of the substrate 21, die press forming is performed using an insulating ceramic powder as a starting material. Also, the substrate molded body 252 is formed as a two-part split molded body, each split half having in its mating surface a recessed portion for accommodating the element molded body 251. Then, the element molded body 251 is sandwiched between the recessed portions of the split halves of the substrate molded body 252 so as to be accommodated therein, and press compression is carried out. Subsequently, after undergoing debindering treatment, a baking step such as hot pressing step, and the like, its outer peripheral surface is shaped by being ground into a semi-spherical rod-like shape, thereby forming the ceramic heater 20.

<Heater Press-Fitting Step>

Next, the connecting ring 35 is formed by forming a steel material such as stainless steel into a pipe shape, and is press fitted to the ceramic heater 20 to establish an electrical connection with the electrode lead-out portion 26. Similarly, the tubular body 80 is also formed into a predetermined shape, and is press fitted to the ceramic heater 20 to establish electrical conduction with the electrode lead-out portion 25. Au or Cu plating or the like may be provided to stabilize the electrical connection.

<Center Pole Processing Step>

The center pole 30 is processed as follows. As shown in FIG. 4, a rod-like member 270 serving as the base material of the center pole 30 is obtained by drawing an iron-based material such as SUS 430 into a rod shape by rolling, then forming into a predetermined size using a drawing die (not shown), and cutting to a fixed size (rolling step). Further, the outer peripheral surface of the rod-like member 270 is machined to cut out the engaging portion 33, the small-diameter portion 37, and the terminal engaging portion 36, thereby completing the shape of the center pole 30 (center pole forming step).

Next, after the outer peripheral surface of the small-diameter portion 37 is subjected to surface processing into a knurled form (surface processing step), the center pole 30 is set in the mold 260 in which a cavity 261 for forming the shape of the vibration preventing member 200 has been formed. Then, an insulative and elastic silicone is injected into the cavity 261 by means of an injection molding machine (not shown) to mold the vibration preventing member 200, and the vibration preventing member 200 is fixed to the small-diameter portion 37 of the center pole 30 (injection molding step).

Even in a case where the dimension A (see FIG. 1) of the aforementioned clearance, which is the amount of projection of the vibration preventing member 200 in the radial direction of the center pole 30, is small, by disposing the vibration preventing member 200 on the small-diameter portion 37 which is formed in a recessed shape with respect to the outer peripheral surface of the center pole 30, the thickness of the vibration preventing member 200 can be set to one corresponding to a size in which the depth B of the small-diameter portion 37 and the dimension A of the clearance are combined. In addition, if the vibration preventing member 200 is formed by injection molding as described above, control of its thickness is facilitated as compared with the case where the vibration preventing member 200 is formed by cutting or the like.

<Center Pole Joining Step>

Then, the engaging portion 33 of the leading end portion 31 of the center pole 30 is inserted into the connecting ring 35 of an integrated heater member 250, and in a state in which the stepped portion at the rear end of the engaging portion 33 abuts the connecting ring 35, the outer periphery is subjected to laser welding. The center pole 30 and the integrated heater member 250 are thereby integrally joined, thus forming the heater/center pole integrated member 90 in which the center pole 30 and the ceramic heater 20 are connected by the connecting ring 35.

<Shell Joining Step>

Next, as for the metal shell 40, an iron-based material such as S45C is formed into a tubular shape with the tool engaging portion 46 and the like formed thereon, and the thread of the externally threaded portion 42 is formed by form rolling. The heater/center pole integrated member 90 including the integrated heater member 250 in which the ceramic heater 20 and the tubular body 80 have been integrated is inserted into the axial hole 43 (see FIG. 1) of this metal shell 40. At this time, as for the heater/center pole integrated member 90, the rear end portion 32 side of the center pole 30 is first inserted into the axial hole 43 from the leading end portion 41 side of the metal shell 40. The vibration preventing member 200 is press fitted since the thickness C (see FIG. 2) of its leading end side is greater than the size in which the dimension A of the aforementioned clearance and the depth B of the small-diameter portion 37 are combined. However, the insertion can be effected smoothly since the depth D on the rear end side is substantially identical to the size in which the dimension A of the aforementioned clearance and the depth B of the small-diameter portion 37 are combined. Further, even if friction occurs between the inner peripheral surface of the axial hole 43 and the outer peripheral surface of the vibration preventing member 200, the vibration preventing member 200 is not turned up. This is because the vibration preventing member 200 is constructed with a large thickness, as described above, in addition to the fact that the vibration preventing member 200 is fixed to the small-diameter portion 37 which has been subjected to surface processing to have a knurled form.

Then, the inner periphery of the leading end portion 41 of the metal shell 40 is engaged with the engaging portion 83 of the tubular body 80, and the metal shell 40 and the tubular body 80 are joined by laser welding. It should be noted that, to avoid rusting of the metal shell 40 which is formed of an iron-based material, a rust preventing treatment such as plating or a coating may be provided after the metal shell 40 is joined to the tubular body 80.

<Terminal Assembly Step>

Subsequently, the O-ring 70 and the holding ring 60 are engaged with the rear end portion 32 of the center pole 30, and are accommodated in the enlarged-diameter portion 45 of the axial hole 43. Further, the pin terminal 50 is fitted over the terminal engaging portion 36 of the rear end portion 32, and the outer periphery of the trunk portion 52 is crimped in a state in which the holding ring 60 is pressed toward the leading end side by the collar portion 51. As a result, the pin terminal 50 is fixed to the center pole 30 in a state in which the holding ring 60 and the O-ring 70 are positioned, thereby completing the glow plug 100.

Figure 5:
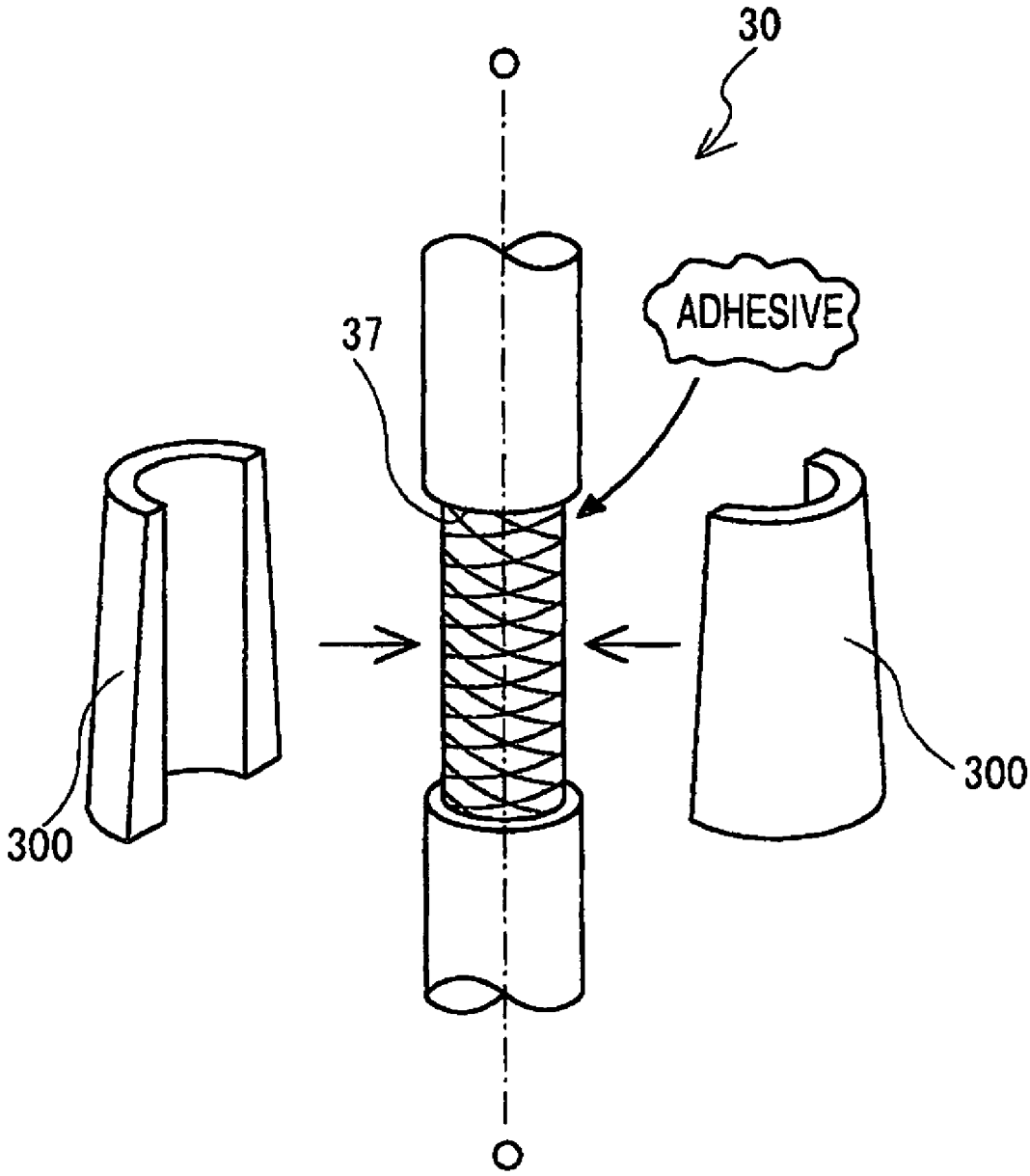
FIG. 5 is a perspective view illustrating a modified vibration preventing member 300.
Figure 6:
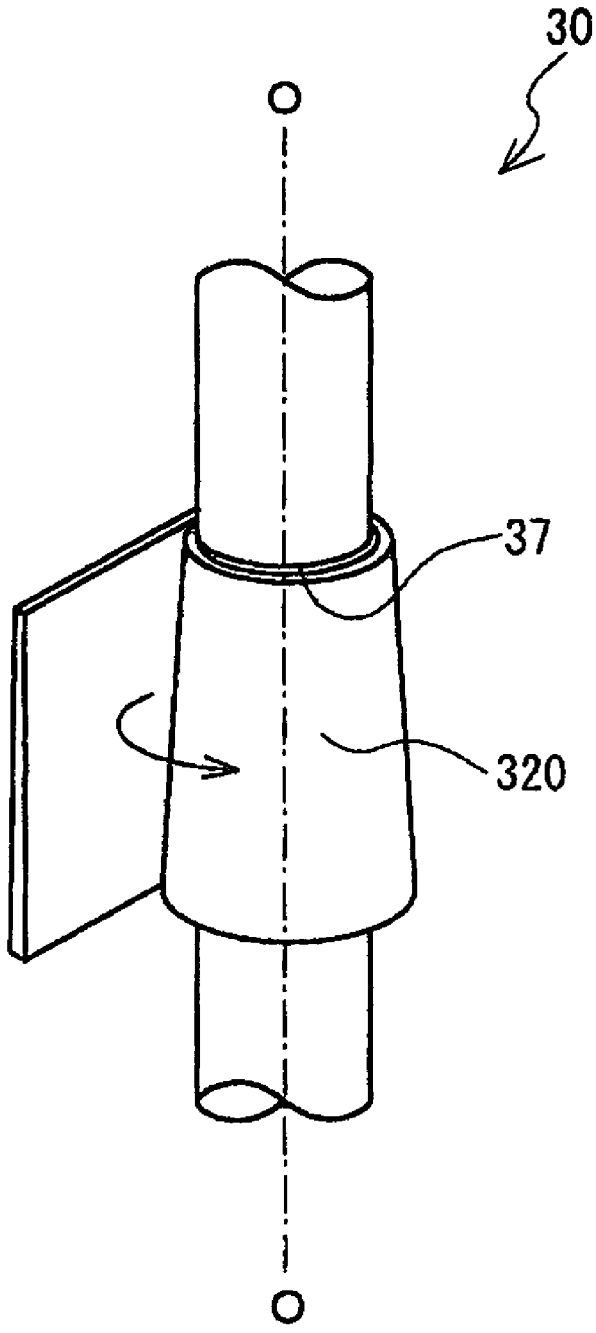
FIG. 6 is a perspective view illustrating another modified vibration preventing member 320.
Figure 7:
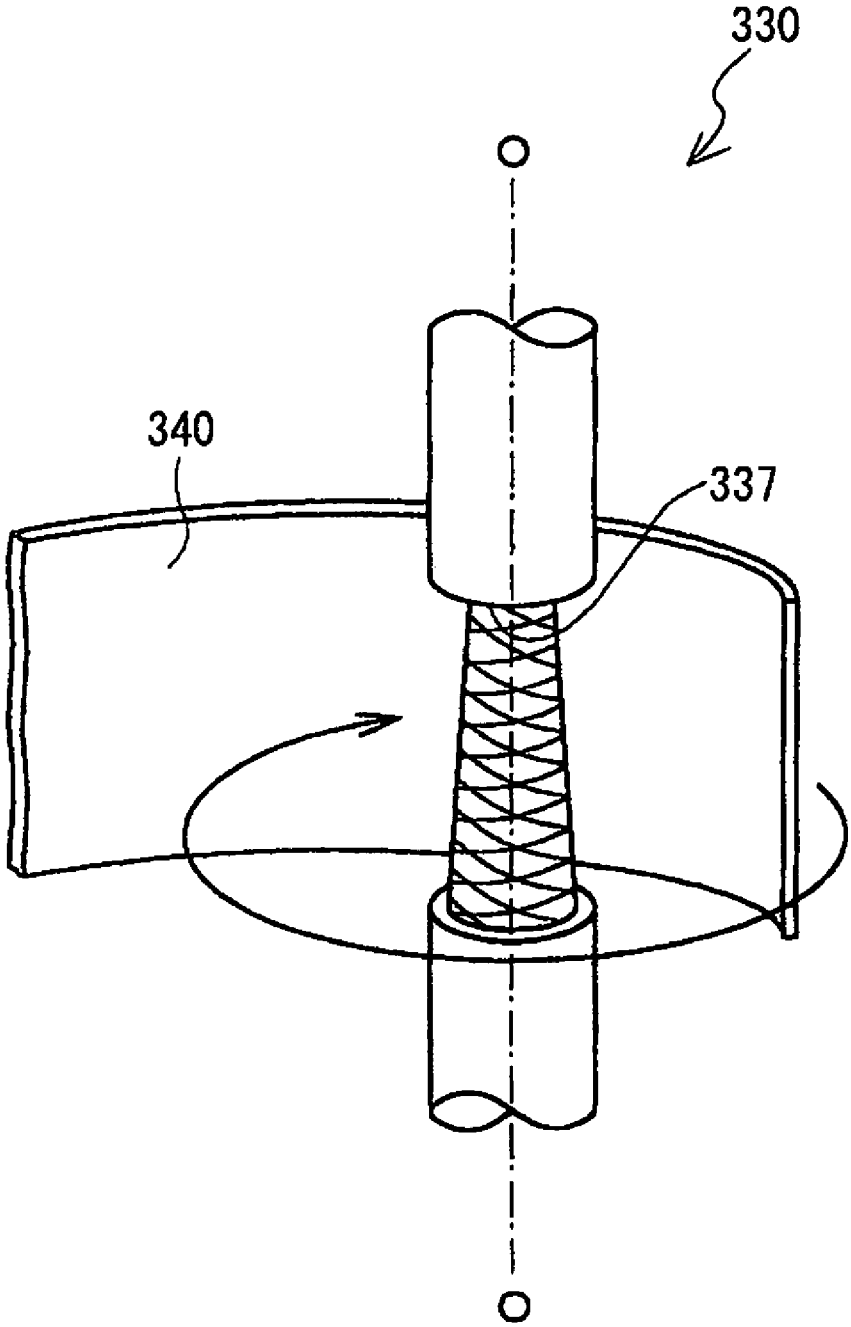
FIG. 7 is a perspective view illustrating yet another modified vibration preventing member 340.

It should be noted that various modifications may be made in accordance with the invention. For example, in the above embodiment the vibration preventing member 200 is formed on the small-diameter portion 37 of the center pole 30 by injection molding. As shown in FIG. 5, the vibration preventing member 300 may be injection molded in advance as a two-part split shape, and the split halves may be integrally fixed to the small-diameter portion 37 of the center pole 30 by, for instance, an adhesive or the like. Still alternatively, as shown in FIG. 6, the vibration preventing member 320 may be provided in tape form and fixed by winding around the small-diameter portion 37 of the center pole 30 in a circumferential direction. Particularly, if a vibration preventing member (in tape form) is used whose thickness on the side which is disposed on the rear end side in the direction of the axis O (upper side in the drawing) is smaller than the thickness on the side which is disposed on the leading end side (lower side in the drawing), after winding around the small-diameter portion 37, the cumulative thickness on the leading end side of the vibration preventing member 320 will likewise be greater than the thickness on the rear end side. Still alternatively, as shown in FIG. 7, the outside diameter of a small-diameter portion 337 of a center pole 330 may be formed in advance so as to be greater on the leading end side than on the rear end side in the direction of the axis O. If such an arrangement is provided, even if a tape-like vibration preventing member 340 having a uniform thickness is wound around that small-diameter portion 337, the outer diameter at the leading end side of the vibration preventing member 340 after winding can likewise be set to be greater than the outer diameter at the rear end side. In addition, if the vibration preventing member is provided in the form of an elastic tube (not shown), the center pole 30 may be inserted therein so as to forcibly expand its tubular interior and allow the vibration preventing member to be fitted over the small-diameter portion 37.

Figure 8:
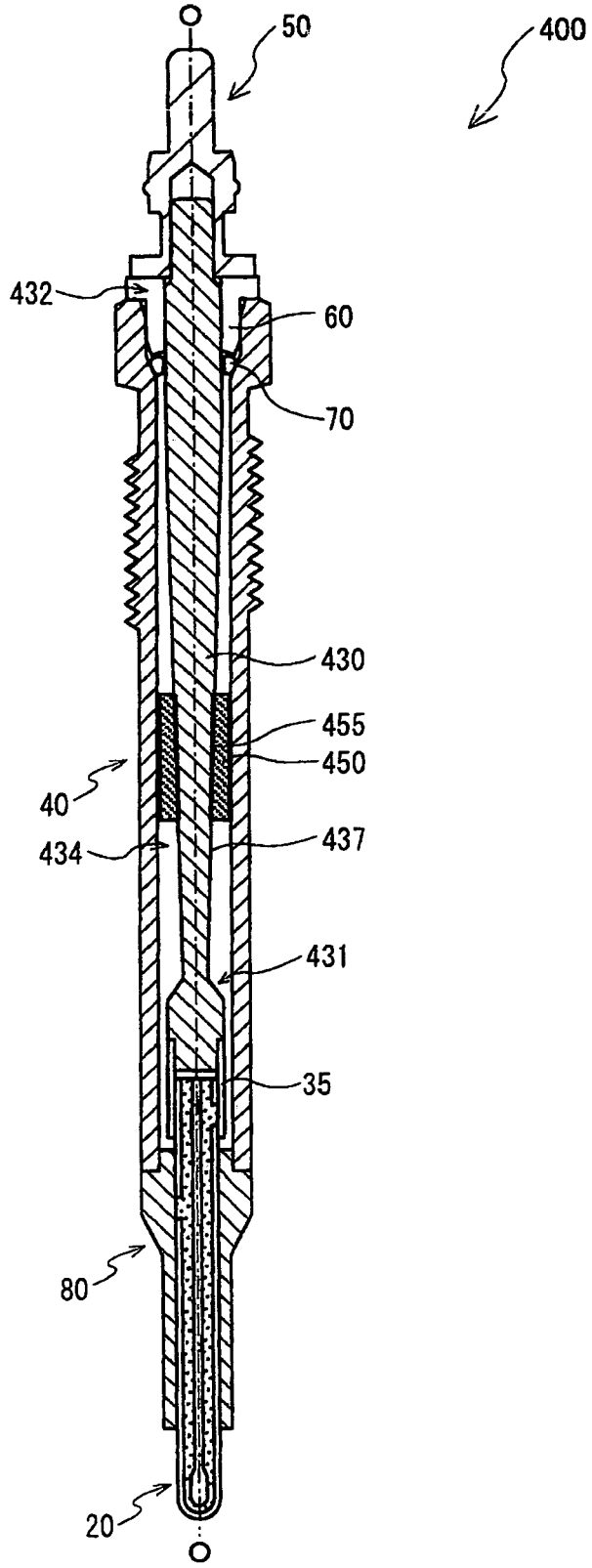
FIG. 8 is a vertical cross-sectional view of a modified glow plug 400.
Figure 9:
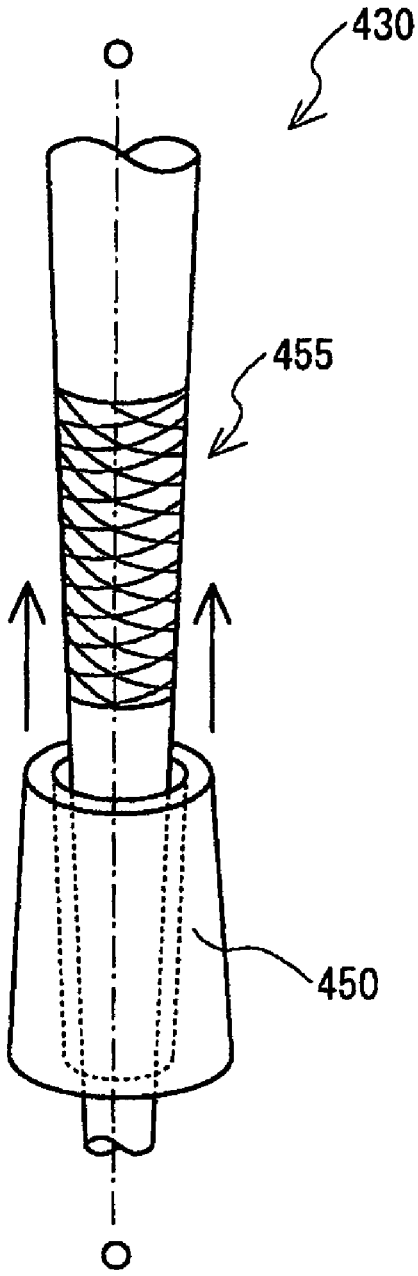
FIG. 9 is a perspective view illustrating a further modified vibration preventing member 450.

In addition, as in the case of a glow plug 400 shown in FIG. 8, a vibration preventing member 450 may be fixed to a center pole 430 which is so configured that a trunk portion 434 as a whole is formed as a small-diameter portion 437. The center pole 430 is fabricated such that the trunk portion 434 in terms of its shape is tapered from a rear end portion 432 side toward a leading end 431 side so that the stress which is transmitted to the integrally joined ceramic heater 20 can be alleviated. To fix the vibration preventing member 450 to such a center pole 430, it suffices if the vibration preventing member 450 is formed into a tubular shape, and is fixed so as to be fitted over a fixing portion 455 subjected to surface processing into a knurled form on an outer peripheral surface of the trunk portion 434, as shown in FIG. 9. Such being the case, however, the vibration preventing member 450 may be formed by injection molding as in the case of the above embodiment. Thus, even if the outer peripheral surface of the portion formed as the small-diameter portion 437 is inclined in a tapered manner with respect to the direction of the axis O, if the surface of the fixing portion 455 is processed to have a knurled form, the vibration preventing member 450 can be fixed to the center pole 430 more reliably. The vibration preventing member 450 may, of course, be bonded to the center pole 430. Further, it is even more preferable if an arrangement is provided such that the outside diameter of the leading end side of the vibration preventing member 450 after being fixed to the center pole 430 becomes greater than the outside diameter of the rear end side.

The surface processing of the outer peripheral surface of such a small-diameter portion 37 is not limited to knurling, and the surface may be processed to have a projection(s), a groove(s), or a thread, or processed to have a coarse surface. In addition, the outer peripheral surface of the small-diameter portion 37 need not be subjected to surface treatment. If the vibration preventing member 200 is formed by injection molding as in this embodiment, the vibration preventing member 200 can be sufficiently fixed to the center pole 30 even if the small-diameter portion 37 is not subjected to surface processing.

Figure 10:
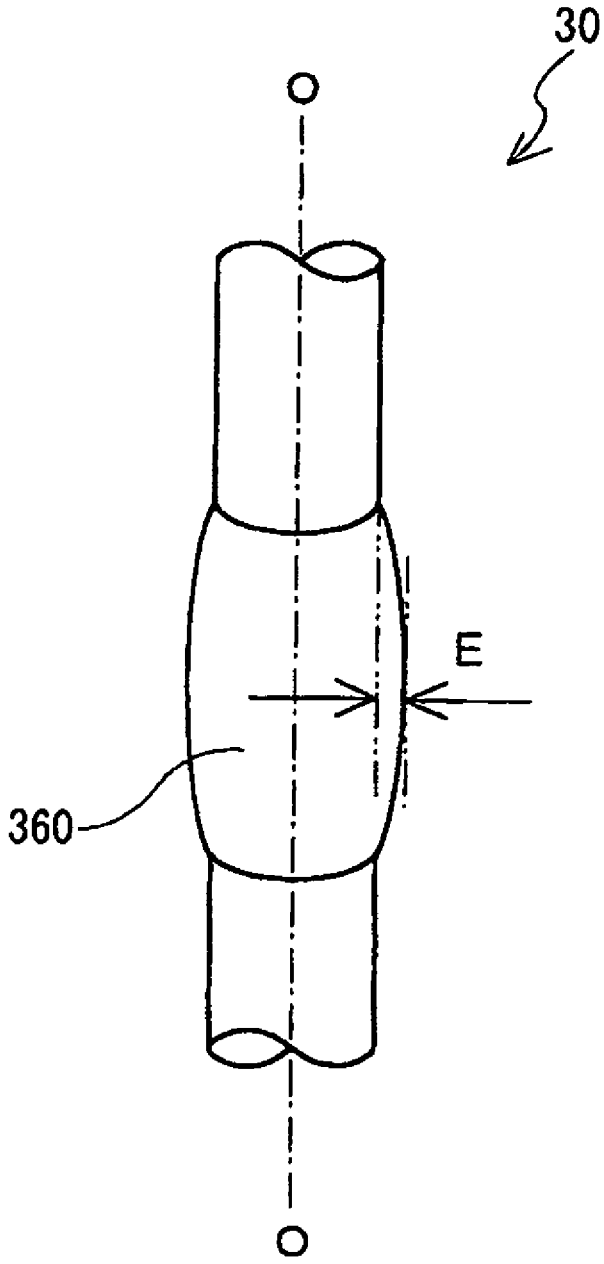
FIG. 10 is a perspective view illustrating a yet further modified vibration preventing member 360.

In addition, edge portions of the vibration preventing member in the direction of the axis O may be chamfered or round chamfered, or a central portion in the direction of the axis O may be configured to bulge in the direction of the axis O as in the vibration preventing member 360 shown in FIG. 10. At this time, if a maximum bulging width E with respect to the outer peripheral surface of the center pole 30 in the radial direction of the axis O is configured to substantially agree with the dimension A (see FIG. 1) of the clearance between the inner peripheral surface of the axial hole 43 of the metal shell 40 and the outer peripheral surface of the center pole 30, the vibration preventing member 360 is able to obtain a sufficient thickness, and is able to effectively restrict the vibration amplitude of the heater/center pole integrated member 90. Further, if the bulging width R of the vibration preventing member 360 is configured to be greater than the dimension A of the clearance, the vibration preventing member 360 can be press fitted into the axial hole 43 of the metal shell 40, and it is possible to obtain a similar advantage as that of detailed embodiment described above.

In addition, grooved or projecting irregularities may be provided on the outer peripheral surface of the vibration preventing member 200. In this manner, the area with which the vibration preventing member 200 contacts the inner peripheral surface of the axial hole 43 of the metal shell 40 can be made small, and the frictional resistance can be reduced, so that the center pole 30 can be easily inserted into the axial hole 43 in the above-described shell joining step.

In addition, although in the above embodiment the vibration preventing member 200 is fixed to the small-diameter portion 37 formed substantially on the center of the trunk portion 34 of the center pole 30, the small-diameter portion 37 and the vibration preventing member 200 may be provided in plural numbers, and are not limited to a single one thereof.

In addition, although in the above embodiment, as the flexible member, the vibration preventing member 200 is described as being formed of an insulative and elastic silicone, the vibration preventing member may be fabricated from an insulative rubber, a soft plastic, or the like. Further, if the center pole 30 is coated with an insulative coating or the like, an electrically conductive vibration preventing member may be used. The vibration preventing member may, of course, be formed from a member which has inferior elasticity, but in such a case it is difficult to press fit the vibration preventing member 200 into the metal shell 40 during assembly. Therefore, to suppress the amplitude of the portion constituting the vibration loop of the center pole 30 while securing ease in assembly, the outer peripheral surface of the vibration preventing member 200 desirably contacts or is in substantially close proximity to the inner peripheral surface of the axial hole 43.

In addition, although the heater member provided in the glow plug 100 is described as the ceramic heater 20 in conjunction with its manufacturing method, the invention is not limited thereto, and the heater member may be manufactured by any known manufacturing method. Further, the heater member is not limited to the ceramic heater 20, and may be a sheathed heater in which a coil-like heat-generating resistor or a control resistor is disposed in a metallic sheath tube with its leading end portion closed semispherically. Namely, in the invention, the shape of the heater member is not limited, and the heat generation specifications of the heater may be set appropriately.

In addition, although the ceramic heater 20 of the heater/center pole integrated member 90 is held indirectly by the metal shell 40 through the tubular body 80, the ceramic heater 20 may be held directly by the metal shell 40. Similarly, although the rear end portion 32 of the center pole 30 of the heater/center pole integrated member 90 is held indirectly by the metal shell 40 through the holding ring 60 and the O-ring 70, the rear end portion 32 of the center pole 30 may be held directly by the metal shell 40.

EXAMPLES

In a first example, a simulation analysis was conducted to specifically define a desirable state of the strength of the heater/center pole integrated member 9, namely, its mechanical rigidity.

Figure 11:
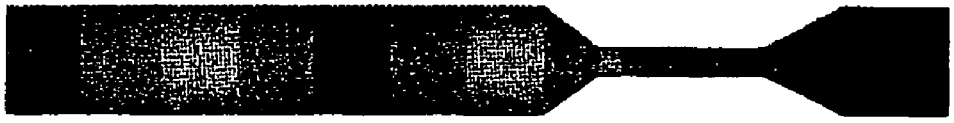
FIG. 11 is a diagram illustrating a first heater/center pole integrated member adopted for simulation.

A first model of the solid cylindrical heater/center pole integrated member 90, formed of SUS 430 and having a constricted portion (a reduced outside-diameter portion FIG. 11) with an outside diameter of Φ1.0 mm corresponding to the small-diameter portion 37, was simulated. As shown in FIG. 11, this first model was prepared as having a large outside diameter relative to the constricted portion to facilitate an understanding of the strength of the constricted portion, while setting the weight of the portion excluding the constricted portion to be identical to that of the heater/center pole integrated member. In the drawing, the side located leftwardly of the constricted portion and having a large mass corresponds to the leading end side of the heater/center pole integrated member 90.

Figure 12:
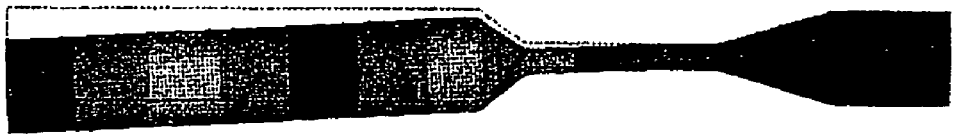
FIG. 12 is a diagram illustrating simulated bending of the integrated member of FIG. 11 upon application of a load.

A load, regarded as being equivalent to a vibrational load to which the heater/center pole integrated member 90 is subjected when the glow plug 100 is mounted in the engine head and subjected to vibration upon engine operation, was applied to this first model. Specifically, as shown in FIG. 12, a state was simulated in which one end on the right side in the drawing of the first model corresponding to the rear end side of the heater/center pole integrated member 90 was fixed, and a 200 g weight was suspended at a position 25 mm from that one end. A bending of less than 5° with respect to the original extending direction occurred at the constricted portion of the first model.

Figure 13:
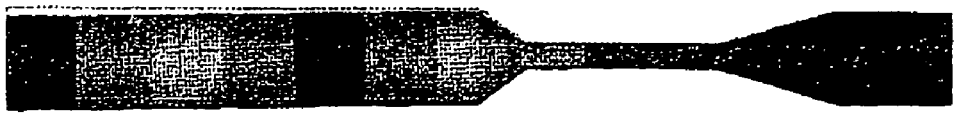
FIG. 13 is a diagram illustrating simulated restoration of the integrated member of FIG. 12 from its bent state upon release of the load.

When the weight was removed to release the load, the constricted portion of the first model was restored from its bent state to a state close to that persisting before application of the load, as shown in FIG. 13.

Figure 14:
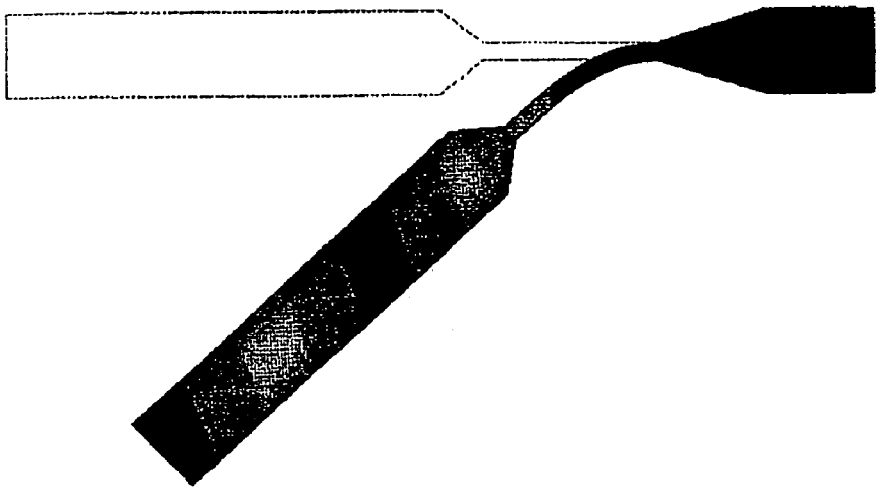
FIG. 14 is a diagram illustrating simulated bending of a second heater/center pole integrated member upon application of a load.

Next, a second model of the solid cylindrical heater/center pole integrated member 90, which was formed of SUS 430 and had a constricted portion with an outside diameter of Φ1.0 mm corresponding to the small-diameter portion 37 in the same manner as described above, was simulated. As shown in FIG. 14, a state was simulated in which, in the same way as described above, one end on the right side in the drawing of the second model corresponding to the rear end side of the heater/center pole integrated member 90 was fixed, and a 200 g weight was suspended at a position 25 mm from that end. A bending of greater than 30° with respect to the original extending direction occurred at the constricted portion of the second model.

Figure 15:
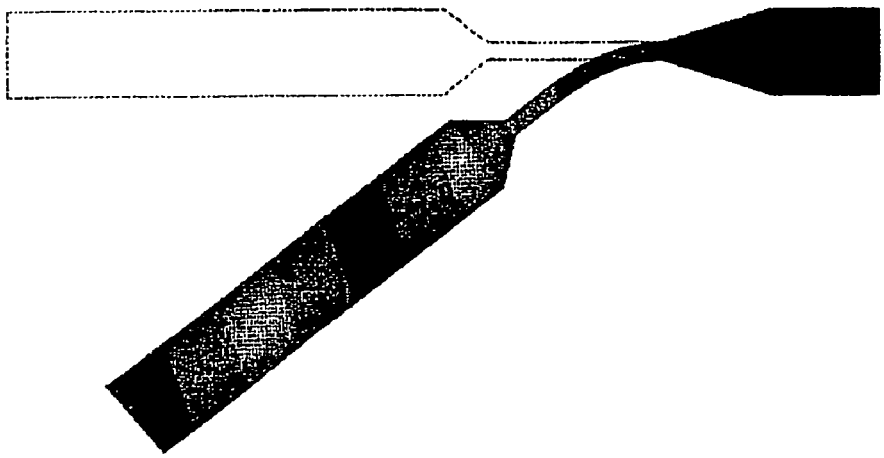
FIG. 15 is a diagram illustrating simulated permanent bending of greater than 30° of the integrated member of FIG. 14 upon release of the load.

The weight was then removed to release the load, but the constricted portion of the second model was practically not restored from its bent state, and permanent bending of greater than 30° with respect to the original extending direction remained, as shown in FIG. 15.

Thus, when a state is simulated in which one end of a model is fixed, and a 200 g weight is suspended at a position 25 mm from that one end, if bending of greater than 30° occurs with respect to the original extending direction of the model, the model is unable to restore itself to a state close to its original state. In this Example, although not shown, other models, which used Cu and in which the outside diameter of the constricted portion was set to Φ1 mm, Φ0.8 mm, and Φ1.4 mm, were respectively prepared by simulation. Simulations were then carried out in which a similar load was applied to the respective models, and the load was subsequently released. As a result, it was found that the models in which a bending of greater than 30° had occurred at the constricted portion with respect to the original extending direction were unable to restore themselves to a state close to their original state after release of the load. Thus, on the basis of the result of the above-described simulation, the heater/center pole integrated member is defined as being in a mechanically rigid state if the angle of deformation is 30° or less when, with the center pole fixed, a 200 g weight is suspended from the element at a position 25 mm from the side end face of the center pole.

The invention can be used not only for a glow plug having only a heat generating function, but also for a glow plug in which a temperature sensor, a pressure sensor, or the like are incorporated.

This application is based on Japanese Patent Application JP 2006-341833, filed Dec. 19, 2006, the entire content of which is hereby incorporated by reference, the same as if set forth at length.

What is claimed is:

1. A glow plug comprising:

a center pole extending along an axial direction;

a heater including a heating element, said heater being connected to a leading end portion of the center pole;

a metal shell which has an axial hole extending in the axial direction, the center pole being inserted into the axial hole so as to be spaced apart from an inner peripheral surface of the axial hole, the metal shell radially holding a rear end portion of the center pole directly or indirectly while causing the rear end portion of the center pole to project from a rear end portion of the metal shell, the metal shell at its leading end portion radially holding directly or indirectly the heater; and a vibration preventing member for preventing vibration of the center pole, the vibration preventing member being fixed on an outer peripheral surface of the center pole at an axial position corresponding to a portion where an inside diameter of the axial hole of the metal shell is constant.

2. The glow plug as claimed in claim 1, wherein the heater is integrated with the center pole in a mechanically rigid state.

3. The glow plug as claimed in claim 1, wherein the center pole has, within the axial hole of the metal shell, a small-diameter portion formed by configuring a portion of the outer peripheral surface to be of a smaller diameter than another portion of the outer peripheral surface of the center pole, and the vibration preventing member circumferentially covers at least a portion of the small-diameter portion.

4. The glow plug as claimed in claim 3, wherein the outer peripheral surface of the small-diameter portion is subjected to processing so as to increase its surface roughness.

5. The glow plug as claimed in claim 1, wherein the vibration preventing member is press fitted at the time that the center pole is inserted into the axial hole of the metal shell, and is disposed so as to be radially compressed between the inner peripheral surface of the axial hole and the outer peripheral surface of the center pole.

6. The glow plug as claimed in claim 5, wherein the vibration preventing member has a thickness on a leading end side that is greater than a thickness on the rear end side, when the vibration preventing member is fixed to the center pole.

7. The glow plug as claimed in claim 5, wherein an outer peripheral surface of the metal shell has a thread for mounting in an internal combustion engine formed thereon, and the vibration preventing member is disposed within the axial hole at an axial position different from that of the thread.

8. The glow plug as claimed in claim 1, wherein the vibration preventing member is located axially more forward than an external threaded portion of the metal shell, and the vibration preventing member has a thickness that is larger than the clearance between the center pole and the inner peripheral surface of the axial hole of the metal shell at the axial position where the external threaded portion is located.

9. The glow plug as claimed in claim 1, wherein an inside diameter of the axial hole of the metal shell is constant in an axial range from the leading end portion of the center pole to an external threaded portion of the metal shell.

10. The glow plug as claimed in claim 1, wherein an outer diameter of the center pole and vibration preventing member at a leading end portion of the vibration preventing member is greater than an outer diameter at a rear end portion thereof.

* * * * *